US010292901B2

(12) United States Patent
Sebelius et al.

(10) Patent No.: US 10,292,901 B2
(45) **Date of Patent: *May 21, 2019**

(54) SUPPORT STRUCTURE FOR ADMINISTERING CARDIOPULMONARY RESUSCITATION

(71) Applicant: Physio-Control, Inc., Redmond, WA (US)

(72) Inventors: Peter Sebelius, Lund (SE); Per Bergstrom, Gothenburg (SE); Jan Hampf, Saro (SE)

(73) Assignee: Physio-Control, Inc., Redmond, WA (US)

( * ) Notice: Subject to any disclaimer, the term of this patent is extended or adjusted under 35 U.S.C. 154(b) by 15 days.

This patent is subject to a terminal disclaimer.

(21) Appl. No.: 15/497,089

(22) Filed: Apr. 25, 2017

(65) Prior Publication Data

US 2017/0224582 A1 Aug. 10, 2017

Related U.S. Application Data

(60) Continuation of application No. 14/201,441, filed on Mar. 7, 2014, now Pat. No. 10,179,087, which is a continuation of application No. 13/225,218, filed on Sep. 2, 2011, now abandoned, which is a division of application No. 13/197,667, filed on Aug. 3, 2011, now Pat. No. 8,753,298, which is a division of application No. 12/491,881, filed on Jun. 25, 2009, (Continued)

(51) Int. Cl.
*A61H 31/00* (2006.01)

(52) U.S. Cl.
CPC ..... *A61H 31/008* (2013.01); *A61H 31/00* (2013.01); *A61H 31/004* (2013.01); *A61H 31/007* (2013.01); *A61H 2201/1253* (2013.01); *A61H 2205/084* (2013.01)

(58) Field of Classification Search
CPC ..... A61H 31/00; A61H 31/008
See application file for complete search history.

(56) References Cited

U.S. PATENT DOCUMENTS 3,209,747 A * 10/1965 Guentner ..... A61H 31/006 601/106
3,219,031 A * 11/1965 Rentsch, Jr. ..... A61H 31/007 601/41

(Continued)

*Primary Examiner* — Michael J Tsai
*Assistant Examiner* — Christopher E Miller
(74) *Attorney, Agent, or Firm* — McDonnell Boehnen Hulbert & Berghoff LLP

(57) ABSTRACT

The present invention relates generally to a support structure for fixating a patient to a treatment unit, and especially to a support structure for fixating the patient to a cardiopulmonary resuscitation unit. An embodiment of the support structure includes a back plate for positioning behind said patient's back posterior to said patient's heart and a front part for positioning around said patient's chest anterior to said patient's heart. Further, the front part can include two legs, each leg having a first end pivotably connected to at least one hinge and a second end removably attachable to said back plate. Said front part can further be devised for including a compression/decompression unit arranged to automatically compress or decompress said patient's chest when said front part is attached to said back plate.

11 Claims, 7 Drawing Sheets

Related U.S. Application Data now abandoned, which is a continuation of application No. 10/105,054, filed on Mar. 21, 2002, now Pat. No. 7,569,021.

(56) References Cited

U.S. PATENT DOCUMENTS 3,241,551 A * 3/1966 Tambascia ..... A61H 31/007 100/252
3,254,645 A * 6/1966 Rand ..... A61H 31/005 601/41
3,277,887 A * 10/1966 Thomas ..... A61H 31/006 5/503.1
3,289,672 A * 12/1966 Thomas ..... A61H 31/006 100/257
3,291,124 A * 12/1966 Jennings ..... A61H 31/006 601/106
3,348,536 A * 10/1967 Tambascia ..... A61H 31/006 128/205.14
3,489,140 A * 1/1970 Mullikin ..... A61H 31/006 601/41
3,512,522 A * 5/1970 Greenlee ..... A61H 31/006 601/106
3,552,390 A * 1/1971 Muller ..... A61H 31/006 128/205.13
3,610,233 A * 10/1971 Barkalow ..... A61H 31/006 601/106
3,739,771 A * 6/1973 Gaquer ..... A61H 31/007 601/41
3,782,371 A * 1/1974 Derouineau ..... A61H 31/007 601/105
3,985,126 A * 10/1976 Barkalow ..... A61H 31/008 601/106
4,198,963 A * 4/1980 Barkalow ..... A61H 31/006 128/207.15
4,233,980 A * 11/1980 McRae ..... A61F 5/34 601/148
4,273,114 A * 6/1981 Barkalow ..... A61H 31/005 601/106
4,338,924 A * 7/1982 Bloom ..... A61H 31/006 128/205.25
4,440,432 A * 4/1984 Goris ..... B66C 1/36 24/599.8
4,770,164 A * 9/1988 Lach ..... A61H 31/005 601/41
4,895,173 A * 1/1990 Brault ..... A61G 1/01 128/870
5,184,606 A * 2/1993 Csorba ..... A61H 31/007 601/134
5,257,619 A * 11/1993 Everete ..... A61H 31/008 601/41
5,287,846 A * 2/1994 Capjon ..... A61H 31/008 601/44
5,327,887 A * 7/1994 Nowakowski ..... A61H 31/006 128/202.13
5,399,148 A * 3/1995 Waide ..... A61H 31/00 601/106
5,498,051 A * 3/1996 Sponsler ..... B60N 2/01583 296/65.03
5,823,185 A * 10/1998 Chang ..... A61H 31/007 128/204.18
5,934,630 A * 8/1999 Williams ..... A47B 13/003 248/188
6,145,801 A * 11/2000 Herring, Jr. ..... G10G 5/00 211/85.6
6,171,267 B1 * 1/2001 Baldwin, II ..... A61H 31/00 601/106
6,174,295 B1 * 1/2001 Cantrell ..... A61H 31/00 601/41
6,250,703 B1 * 6/2001 Cisler ..... B60N 2/01583 296/65.03
6,290,660 B1 * 9/2001 Epps ..... A61H 23/008 601/103
6,332,872 B1 * 12/2001 Young ..... A61H 31/007 601/107
D461,008 S * 7/2002 Hampf ..... D24/167
6,446,285 B1 * 9/2002 Chinn ..... A61G 1/04 108/49
6,648,841 B1 * 11/2003 Sessler ..... A61H 31/007 601/41
8,002,720 B2 * 8/2011 Hansen ..... A61H 31/00 601/107
2003/0132588 A1 * 7/2003 Senger ..... B60N 2/01541 280/30

* cited by examiner

SUPPORT STRUCTURE FOR ADMINISTERING CARDIOPULMONARY RESUSCITATION

CROSS-REFERENCE TO RELATED APPLICATIONS

This application is a continuation of U.S. patent application Ser. No. 14/201,441 filed Mar. 7, 2014, which is a continuation of U.S. patent application Ser. No. 13/225,218 filed Sep. 2, 2011, now abandoned, which is a division of U.S. patent application Ser. No. 13/197,667 filed Aug. 3, 2011, now U.S. Pat. No. 8,753,298 issued Jun. 17, 2014, which is a division of U.S. patent application Ser. No. 12/491,881 filed Jun. 25, 2009, now abandoned, which is a continuation of U.S. patent application Ser. No. 10/105,054 filed Mar. 21, 2002, now U.S. Pat. No. 7,569,021 issued Aug. 4, 2009, all of which are hereby incorporated by reference herein in their entirety.

FIELD

The present invention relates generally to a support structure for fixating a patient to a treatment unit, and especially to a support structure for fixating the patient to a cardiopulmonary resuscitation unit.

BACKGROUND

When a person suffers from a cardiac arrest, the blood is not circulating to nourish the body, which can lead to death of or cause severe bodily damages to the person. To improve the person's chances to survive or to minimize the damages at cardiac arrest it is essential to take necessary measures as quickly as possible to maintain the person's blood circulation and respiration, otherwise the person will succumb to sudden cardiac death in minutes. Such an emergency measure is cardiopulmonary resuscitation (CPR), which is a combination of "mouth to-mouth" or artificial respiration and manual or automatic cardiac compression that helps the person to breathe and maintains some circulation of the blood.

However, CPR does normally not restart the heart but is only used for maintaining the oxygenation and circulation of blood. Instead, defibrillation by electrical shocks is usually necessary to restart the normal functioning of the heart. Thus, CPR has to be performed until the person has undergone electrical defibrillation of the heart. Today, CPR is often performed manually by one or two persons (rescuers), which is a difficult and demanding task, i.e. different measures have to be taken correctly at the right time and in the right order to provide a good result. Further, manual cardiac compression is quite exhausting to perform and especially if it is performed during an extended period of time. Furthermore, it is sometimes necessary to perform cardiopulmonary resuscitation when transporting the person having a cardiac arrest, for example when transporting the person by means of a stretcher from a scene of an accident to an ambulance. In such a situation it is not possible to perform conventional CPR using manual CPR and the apparatuses today providing automatic CPR are not stable enough or easy to position to provide CPR on a person laying on for example a stretcher.

Prior Art

There are today several apparatuses for cardiopulmonary resuscitation available. For example, a cardiopulmonary resuscitation, defibrillation and monitoring apparatus is disclosed in the U.S. Pat. No. 4,273,114. The apparatus comprises a reciprocal cardiac compressor provided for cyclically compressing a patient's chest. U.S. Pat. No. 4,273,114 discloses further a support structure comprising a platform (12) for supporting the back of a patient, a removable upstanding column (13) and an overhanging arm (14) mounted to the column support (13) with a releasable collar (15). A drawback with the disclosed apparatus is that the patient is not secured to the apparatus and it is for example possible for the patient to move in relation to a compressor pad (19) whereby the treatment accuracy decreases.

Another example of an apparatus for cardiopulmonary resuscitation is disclosed in the FR patent document FR 1,476,518. The apparatus comprises a back plate (X) and a front part (Y), the height of which front part (y) can be adjusted by means of two knobs. A drawback with this apparatus is that the front part (Y) may be obliquely fixated to the back plate (X), since the height of each leg of the front part (Y) is adjusted one by one using one of the knobs. Thus if the height of the leg is not equal, an oblique compression of the chest is provided. Yet another drawback is that the patient is not fixated to the apparatus whereby it is possible for the patient to move in relation to the compression means, which in the worst scenario causes a not desired body part to be compressed.

Yet another example of an apparatus for cardiac massage is disclosed in the UK patent document GB 1,187,274. The cardiac massage apparatus comprises a base (1), two guide bushes (2) fixed in the base (1) and two upright members (3), the lower ends of which are mounted in the bushes (3). Further, a cross-piece (6) extends between the two upright members (3), to which cross-piece (6) a bar (9) is mounted. Furthermore, the height of the cross-piece (6) and the bar (9) is adjusted by means of a spring-loaded pin (8) and a stop (11), respectively. A drawback with the disclosed apparatus is that it is not easy to handle and position to provide a quick start of the cardiac massage.

Objects of the Invention

An object of the present invention is to improve the accuracy when providing external treatment to a patient by means of a treatment unit. An aspect of the object is to provide fixation of the patient in relation to a treatment unit. Another aspect of the object is to enable treatment to a patient when the patient is transported on for example a stretcher. Yet another aspect of the object is to enable simple, accurate and effective cardiopulmonary resuscitation of a person suffering from a cardiac arrest.

Another object of the present invention is to provide a portable equipment. An aspect of the object is to provide a space-saving equipment requiring minimal space when not in use.

SUMMARY OF INVENTION

These and other objects and aspects of the objects are fulfilled by means of a support structure according to the present invention as defined in the claims.

The present invention relates generally to a support structure for fixating a patient to a treatment unit, and especially to a support structure for fixating the patient to a cardiopulmonary resuscitation unit. An embodiment of the support structure comprises a back plate for positioning behind said patient's back posterior to said patient's heart and a front part for positioning around said patient's chest anterior to said patient's heart. Further, the front part can comprise two legs, each leg having a first end pivotably connected to at least one hinge and a second end removably attachable to said back plate. Said front part can further be devised for comprising a compression/decompression unit arranged to automatically compress or decompress said patient's chest when said front part is attached to said back plate.

In another embodiment of the invention, the support structure comprises a treatment unit, for example a compression and/or decompression unit.

An embodiment of the invention refers further to a support structure for external treatment of a patient's body part. The support structure comprises a back plate for positioning posterior of said body part, a front part for positioning anterior of said body part, said front part comprising two legs having a first end pivotably connected to a hinge of said front part and a second end removably attachable to said back plate. The front part is further devised for comprising a module or treatment unit arranged to automatically and externally perform treatment of said patient's body part when said front part is attached to said back plate.

The present invention refers also to a front part for use in a support structure for cardiopulmonary resuscitation of a patient having a cardiac arrest, comprising two legs each of which comprising a first end pivotably connected to at least one hinge of said front part and a second end removably attachable to a back plate, wherein said front part is arranged for positioning around said patient's chest anterior to said patient's heart and devised for comprising a compression/decompression unit arranged to automatically compress or decompress said patient's chest when said front part is attached to said back plate.

Further, the invention refers to a back plate for use in a support structure for cardiopulmonary resuscitation of a patient having a cardiac arrest, comprising a shaft-like member arranged to be engaged by means of a claw-like member of a front part.

The invention refers also to a compression/decompression unit for use in a support structure for cardiopulmonary resuscitation of a patient having a cardiac arrest, comprising a pneumatic unit arranged to run and control the compression and decompression, an adjustable suspension unit to which a compression/decompression pad is attached and a handle by means of which the position of said pad can be controlled.

BRIEF DESCRIPTION OF DRAWINGS

The present invention will now be described with reference to the accompanying figures in which.

DETAILED DESCRIPTION

The present invention will now be described in more detail with reference to the accompanying figures.

Figure 1A:
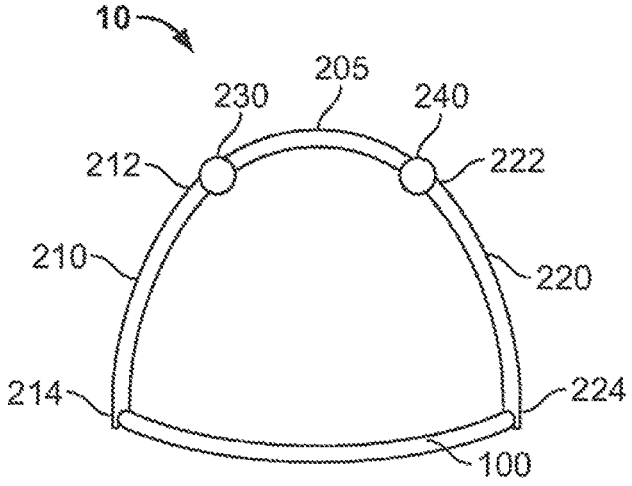
FIG. 1A schematically shows a front view of an embodiment of the support structure according to the invention.
Figure 1B:
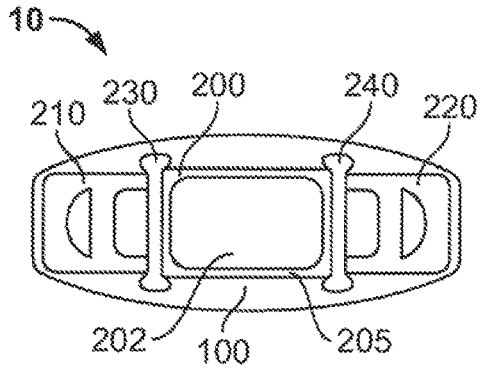
FIG. 1B schematically shows a top view of an embodiment of the support structure according to the invention.

FIGS. 1A and 1B show a front view and a top view, respectively, of an embodiment of a support structure 10 according to the invention. The support structure 10 comprises a base or back plate 100 arranged to be positioned posterior of the patient, e.g. behind the back of a patient to be treated. More specifically, the back plate 100 is arranged to be positioned posterior to the body part to be treated. The support structure 10 comprises further a front part or upper part 200 arranged to be positioned around the patient anterior of the body part to be treated. Further, the front part 200 of the support structure 10 comprises a central part 205 and two legs 210, 220, which legs are arranged to be removably attached or secured at the base plate 100 by means of snap locking or spring latch. As illustrated, the legs 210 and 200 can be bowed or curved.

Figure 4:
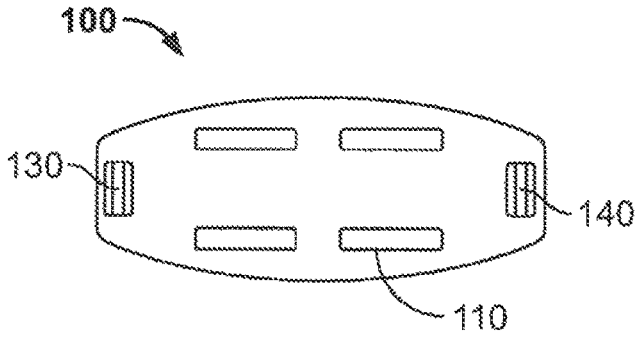
FIG. 4 schematically shows a view from above of an embodiment of a back plate of the support structure according to the invention.

An embodiment of a back plate 100 is schematically shown in FIG. 4. The back plate 100 comprises two shafts 130, 140 or shaft-like members arranged for securing the front part 200 to the back plate 100. The back plate 100 can further comprise one or several handles 110.

Figure 2:
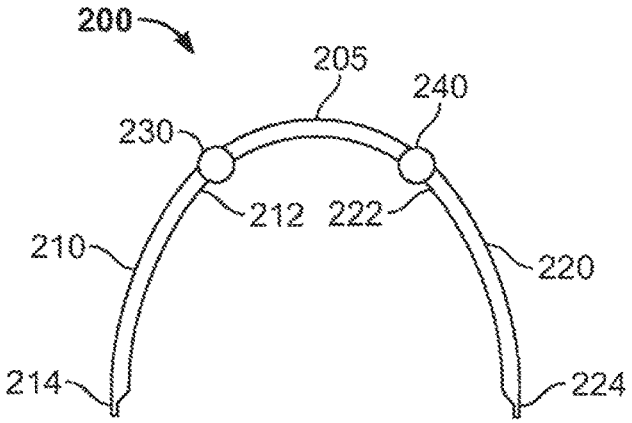
FIG. 2 schematically shows a front view of an embodiment of a front part of the support structure according to the invention.

In an embodiment of the invention, the legs 210, 220 of the front part 200 are pivotably or turnably attached to the central part 205 of the front part 200 by means of a hinge 230, 240 or the like, confer FIG. 2. However, as understood by the person skilled in the art, it is also possible to pivotably attach the legs 210, 220 at the front part 200 by means of only one hinge or the like.

In one embodiment of the invention, a first end 212, 222 of the legs 210, 220 are pivotably arranged at the hinges 230, 240 in such a way that the legs 210, 220 resiliently pivot or turn due to a resilient member 232, 242 of the hinges 230, 240. In an embodiment of the invention, the resilient member 232, 242 is comprised in the inside of the hinge 230, 240 and comprises a torsion spring, cf. FIGS. 11 and 14. Further, when the legs 210, 220 are not forced together, the legs 210, 220 resiliently pivot, by means of a resilient member, from a minimum position having a minimal distance between second ends 214, 224 of the legs 210, 220 to a maximum position having a maximal distance between the second ends 214, 224 of the legs 210, 220.

In an embodiment of the invention, the front part 200 of the support structure 10 is arranged in such a way that the second end 214 of the leg 210 abut against the second end 224 of the leg 220 when the legs 210, 220 are in their minimum positions, i.e. when the support structure 10 is in its folded position. Due to this arrangement of the folded position, the durability of the support structure 10 is increased since the ability of the legs 210, 220 to stand up to an external force is increased. Further, this folded arrangement also protects a possible comprised treatment unit 300.

In one embodiment of the invention, the maximum positions of the second ends 214, 224 of the legs 210, 220 are controlled by means of a stop means provided at the hinge 230, 240, e.g. by means of heels arranged at the first ends 212, 224 of the legs 210, 220 and at the axis of the hinge 230, 240, which heels will stop the legs 210, 220 from turning further apart.

In an embodiment of the invention, the hinge 230, 240 is arranged as a through shaft passing through the first end 212, 222 of the leg 210, 220. The through shaft as well as the first ends 212, 222 is provided with heels arranged to stop the turning of the legs 210, 220.

Figure 12:
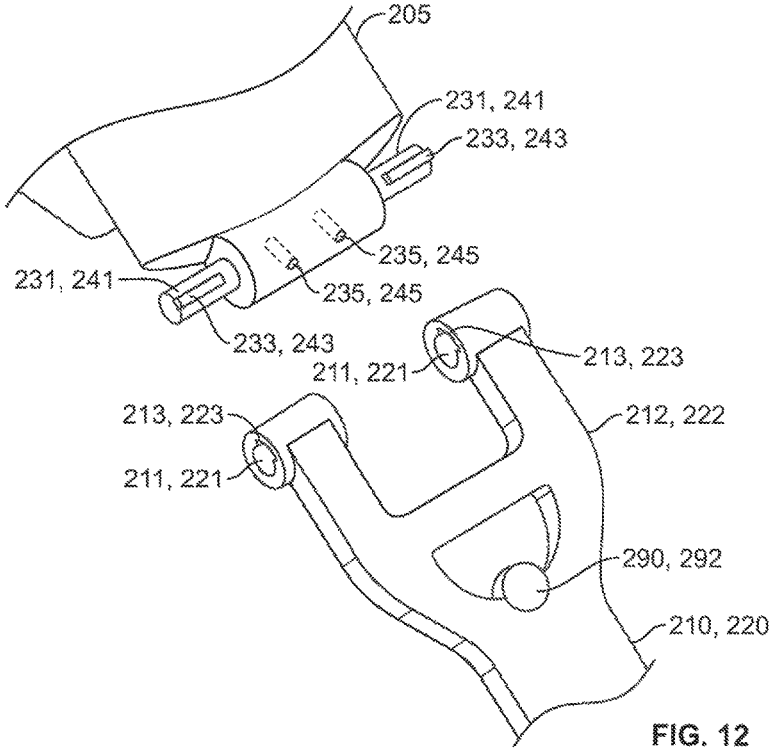
FIG. 12 shows schematically an embodiment of the front part comprising two wedges or heels and an embodiment of the leg comprising two grooves or recesses.

In FIG. 12 an embodiment of a through shaft 231, 241 is shown. The through shaft 231, 241 is provided with two heels or wedges 233, 243 arranged at the ends of the through shaft 231, 241. Further, the through shaft 231, 241 comprises one or several channels or passages 235, 245 arranged for fixating the through shaft 231, 241 to the central part 205 by means of for example pins.

An embodiment of a first end 212, 222 of a leg 210, 220 is also shown in FIG. 12, which first end 212, 222 comprises two cavities or openings 211, 221 and two grooves or recesses 213, 223 constituting a rotation limiting structure. The grooves 213, 223 can be arranged to be wedge-shaped. Further, when the leg 210, 220 is mounted on the central part 205 of the front part 200, the ends of the through shaft 231, 241 is arranged to be positioned in said cavities 211, 221 in such a way that the heels 233, 243 are positioned in the recesses 213, 223.

Figure 13A:
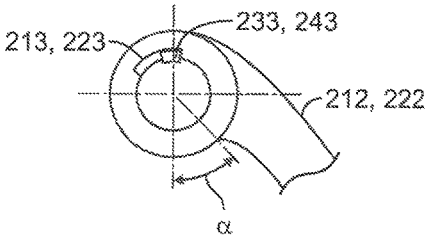
FIG. 13A shows schematically a cut away view of an embodiment of the leg rotated an angle of alpha degrees.
Figure 13B:
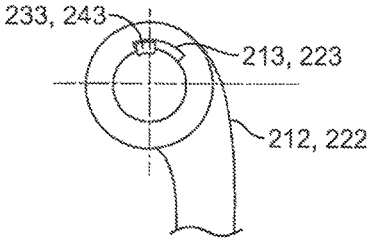
FIG. 13B shows schematically a cut away view of an embodiment of the leg of the support structure in its minimum position.

In FIGS. 13A and 13B, a cut away view of the hinge 230, 240, as previously described with reference to FIG. 12, is schematically shown. The turning of the leg 210, 220 is delimited by means of the recess 213, 223. As illustrated in FIG. 13A the leg 210, 220 has turned an angle alpha corresponding to its unfolded position and in FIG. 13B the leg 210, 220 is in its folded position.

In another embodiment of the invention, the hinge 230, 240 is configured of two shafts, wherein a first shaft having a heel is arranged at the first end 212, 222 of the leg 210, 220 and second shaft having a heel is arranged at the central part 205 of the front part 200. Further, when the leg 210, 220 is mounted on the central part 205 of the front part 200, the first and second shaft will be mounted to each other to form the hinge 230, 240 in such a way that the heels will control the maximum position of the leg 210, 220.

Figure 10:
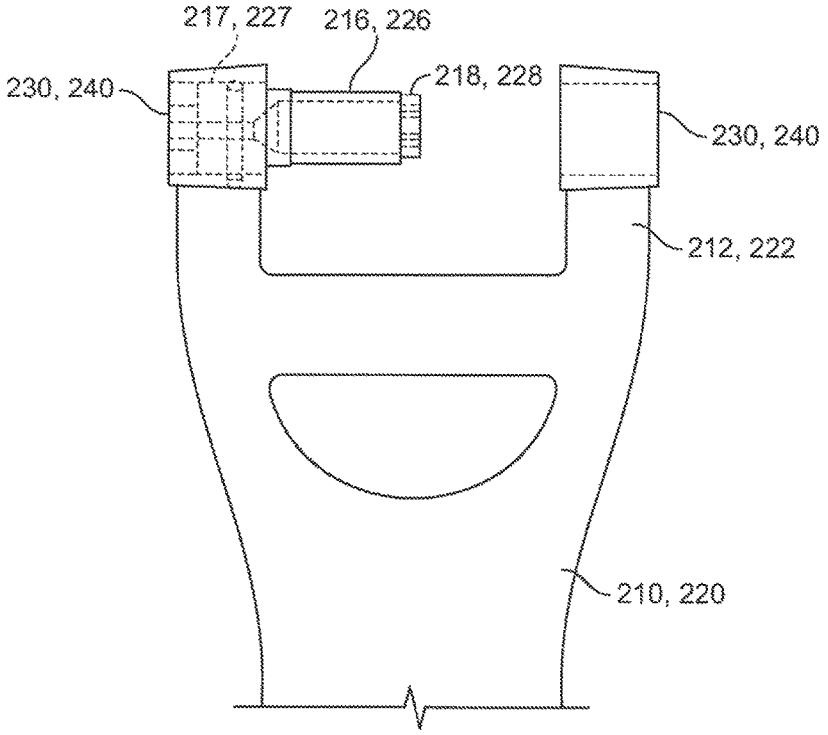
FIG. 10 shows schematically an embodiment of the upper part of the leg of the support structure according to an embodiment of the invention.

In FIG. 10 an embodiment of a first end 212, 222 of a leg 210, 220 is shown. In this embodiment, a first part of the hinge 230, 240 is comprised in the leg 210, 220, which part comprises a first shaft 216, 226, a first shaft supporting structure 217, 227 and a heel 218, 228.

Figure 11:
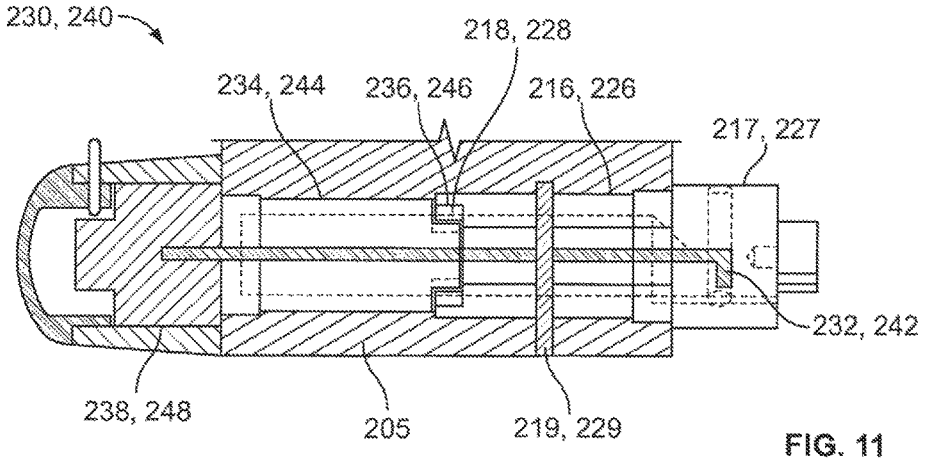
FIG. 11 shows schematically an embodiment of a hinge comprised in an embodiment of the invention.

FIG. 11 shows an embodiment of a hinge 230, 240 when the leg 210, 220 is mounted to the central part 205 of the front part 200. In this embodiment, the hinge 230, 240 comprises a first shaft 216, 226, and a first shaft supporting structure 217, 227 and a heel 218, 228. Further, the hinge 230, 240 comprises a second shaft 234, 244, a second shaft supporting structure 238, 248 and a heel 236, 246.

In this embodiment, the first shaft 216, 226 is pivotably attached to the first shaft supporting structure 217, 227, which is rigidly attached to the first end 212, 222 of the leg 210, 220. Further, the first shaft 216, 226 is rigidly attached to the central part 205 of the front part 200 by means of a pin 219, 229 or the like. However, the first shaft 216, 226 can also be rigidly attached to the central part 205 by means of a groove or a recess (not shown) in the first shaft 216, 226 and a rib or a protrusion (not shown) in the surface of the central part 205 facing the shaft 216, 227. The second shaft 234, 244 is rigidly attached to the second shaft supporting structure 238, 248, which is pivotably attached to the first end 212, 222 of the leg 210, 220. Further, the second shaft 234, 244 is pivotably attached to the central part 205 of the front part 200. Furthermore, the first 218, 228 and second 236, 246 heels are arranged in such a way that they abut against each other when the leg 210, 220 has turned to its maximum position. Heels can also be arranged to abut against each other when the leg 210, 220 has turned to its minimum position. That is, the heels are arranged in such a way that they delimit the turning of the legs 210, 220.

Figure 14:
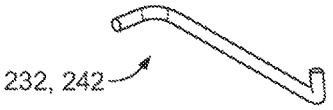
FIG. 14 schematically shows an embodiment of a torsion spring.

In FIG. 11, an embodiment of a resilient member 232, 242 is also shown, which resilient member 232, 242 for example is arranged as a torsion spring, cf. FIG. 14.

Further, the hinge 230, 240 is configured in such a way that the maximum position of the legs 210, 220, i.e. the maximum distance between the second ends 214, 224 of the legs 210, 220, corresponds or approximately corresponds to the distance between the shaft-like members 130, 140 of the back plate 100, cf. FIGS. 2 and 4. Thus, in for example an emergency situation when the support structure 10 is removed from its folded position in a bag or when securing means securing the folded position is withdrawn, the legs 210, 220 turn to their maximum position and the front part 200 can quickly and easily be attached to the back plate 100 by means of the snap locking without requiring any manual securing measures.

Figure 5:
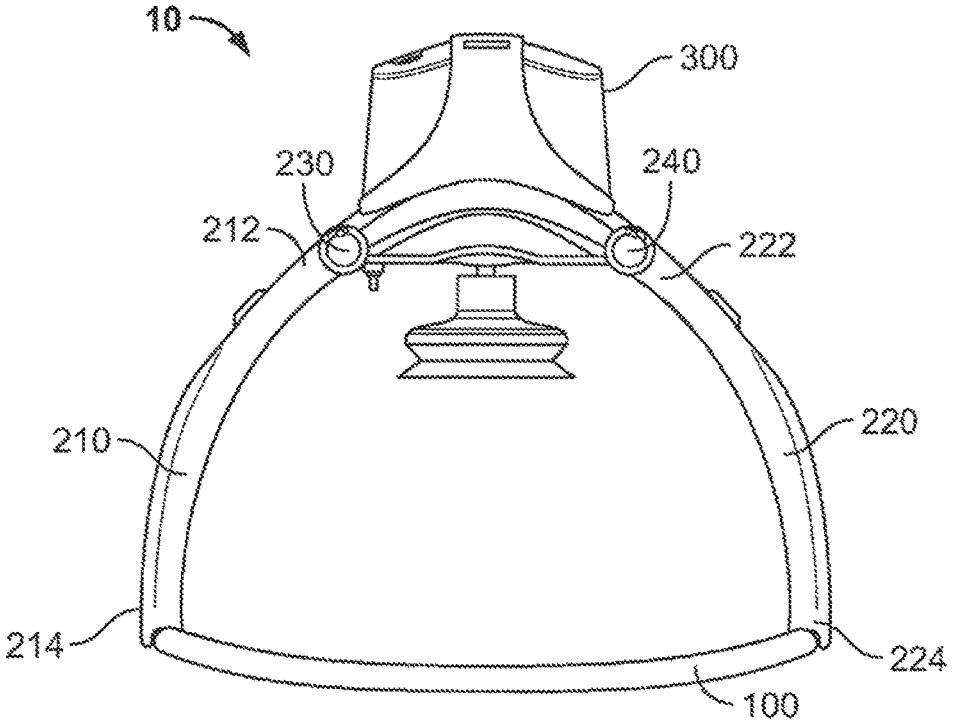
FIG. 5 shows a side view of an embodiment of the invention.

As schematically shown in FIG. 1B an opening or a cut-out 202 is provided at the central part 205 of the front part 200 for enabling arrangement of a treatment unit 300, cf. FIG. 5, at the central part 205 of the front part 200. The treatment unit 300 can for example be a unit providing compression and/or decompression of the chest or sternum of a patient suffering from a cardiac arrest. Further, the treatment unit 300 can comprise or be realized as a monitoring unit, such as an electrocardiograph registering the cardiac activity. Such a unit can comprise necessary electrodes, a control unit and interaction means such as a display unit and/or a command unit.

The treatment unit 300 can further comprise or be realized as a sphygmomanometer arranged to measure the blood pressure. The treatment unit can in this case comprise necessary cuffs, pressure means, a control unit and an interaction means. The treatment unit 300 can further comprise or be realized as a means for measuring the oxygen saturation in blood.

Figure 3A:
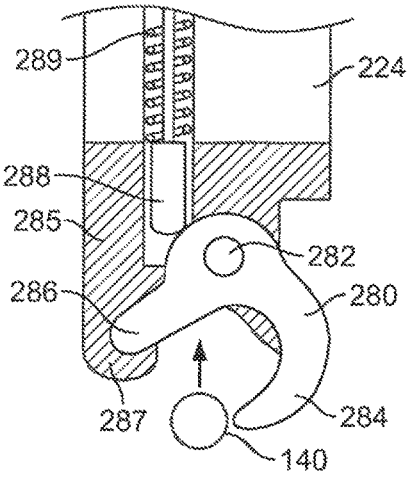
FIG. 3A schematically shows an embodiment of a securing member in an open position.
Figure 3B:
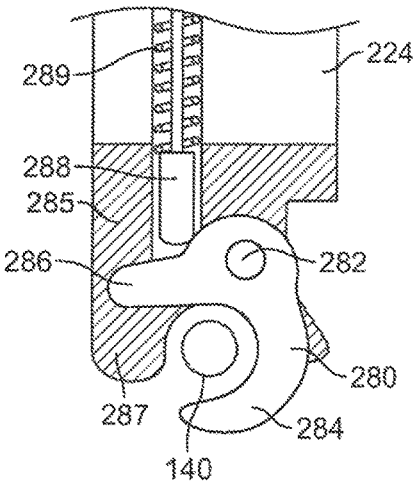
FIG. 3B schematically shows an embodiment of a securing member in a closed position.

When fastening or securing the legs 210, 220 of the front plate 200 to the back plate 100, the shaft-like member 130, 140 will exert a force on a heel 286 of a claw-like member 280 of the second end 214, 224 of the leg 210, 220, as illustrated in FIG. 3A, causing the claw-like member 280 to turn or rotate around its suspension axis 282 until a hook 284 partly or totally encircles the shaft-like member 130, 140 and a pin or cotter 288 falls down to secure the position of the clawlike member 280, as illustrated in FIG. 3B, whereby the front part 200 is secured to the back plate 100. The second end 214, 224 of the leg 210, 220 comprises further a locking support structure 285 having a locking protrusion 287 arranged to further secure the shaft 130, 140. However, the locking protrusion 287 can also be integrated with the second end 214, 224 of the leg 210, 220. In the shown embodiment, the pin 288 is spring-loaded by means of a resilient member 289, e.g. a spring or the like, to enable a quicker fall down and to provide a quick fastening of the front plate 200 to the back plate 100.

Figure 3C:
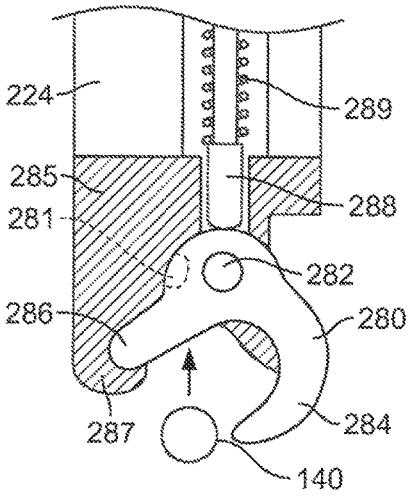
FIG. 3C schematically shows another embodiment of a securing member in an open position.
Figure 3D:
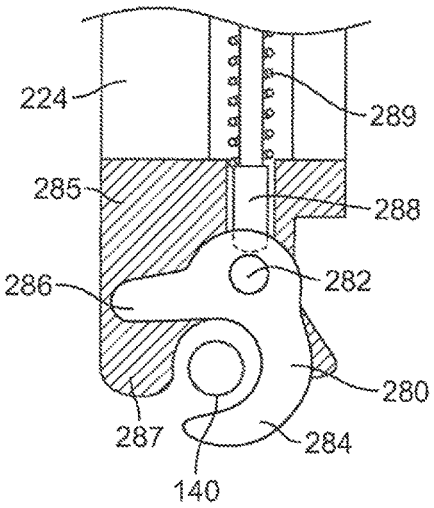
FIG. 3D schematically shows another embodiment of a securing member in a closed position.

In another embodiment of the invention, the pin 288 is arranged to fall down into a hole or recess 281 of the claw-like member 280 when the hook 284 totally or partly surrounds the shaft-like member 130, 140, cf. FIGS. 3C and 3D.

Figure 6:
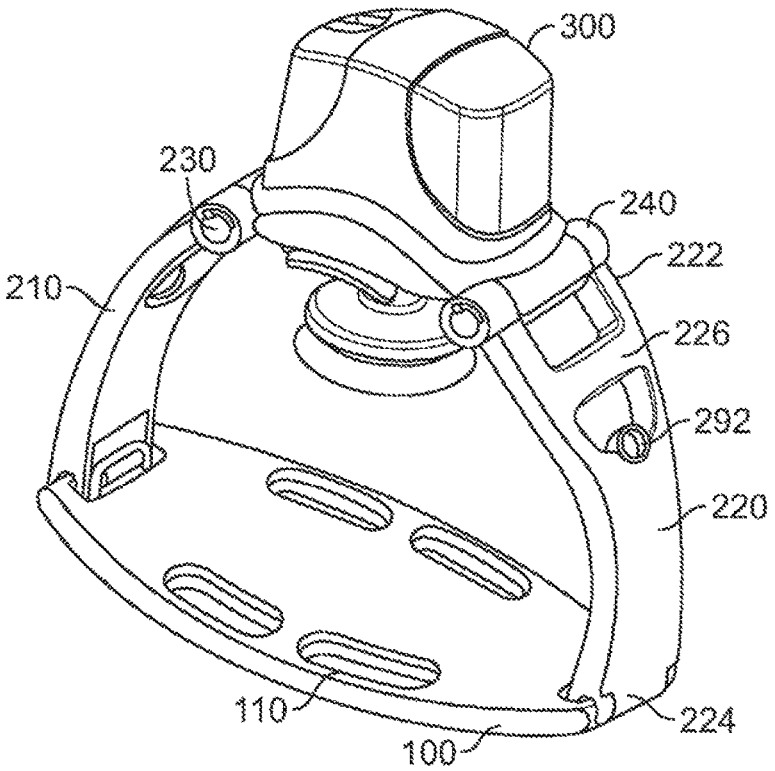
FIG. 6 shows schematically a top view in perspective of an embodiment of the invention.
Figure 7A:
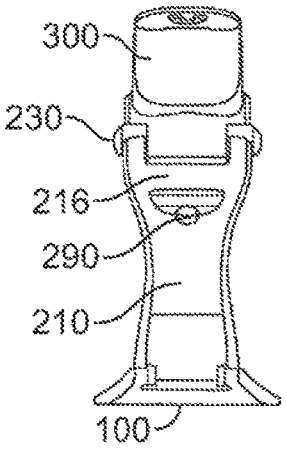
FIGS. 7A and 7B shows schematically side views of embodiments of the invention.
Figure 7B:
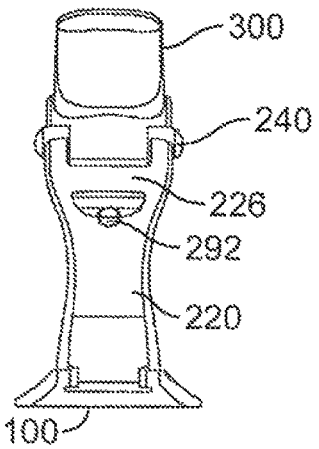

Further, the support structure 10 comprises a disengagement member 290, 292, as schematically illustrated in FIGS. 6, 7A and 7B, which is arranged at said leg 210, 220 to disengage said legs 210, 220 from said back plate 100. In an embodiment of the invention, the disengagement member 290, 292 is arranged to draw up or lift the pin 288, whereby the clawlike member 280 is caused to tum back to its open position, i.e. the claw-like member 280 is disengaged from the shaft-like member 130, 140, and whereby said leg 210, 220 is removable from said back plate 100. The disengagement member 290 can further be arranged to stretch the resilient member 289.

As illustrated in the FIGS. 4, 6, 7A and 7B, an embodiment of the support structure 10 can also be provided with a handle 110 comprised in the back plate 100 and a handle 226 comprised in the front part 200, which handles 110, 226 provide an easy way of carrying the parts of the support structure 10. In an embodiment of the invention the handles 110, 226 are preferably provided by means of openings or cut-outs whereby the weight of the support structure 10 is decreased. However, other embodiments of the invention can also comprise a handle in the shape of a belt, a knob, a strap or the like.

Figure 9:
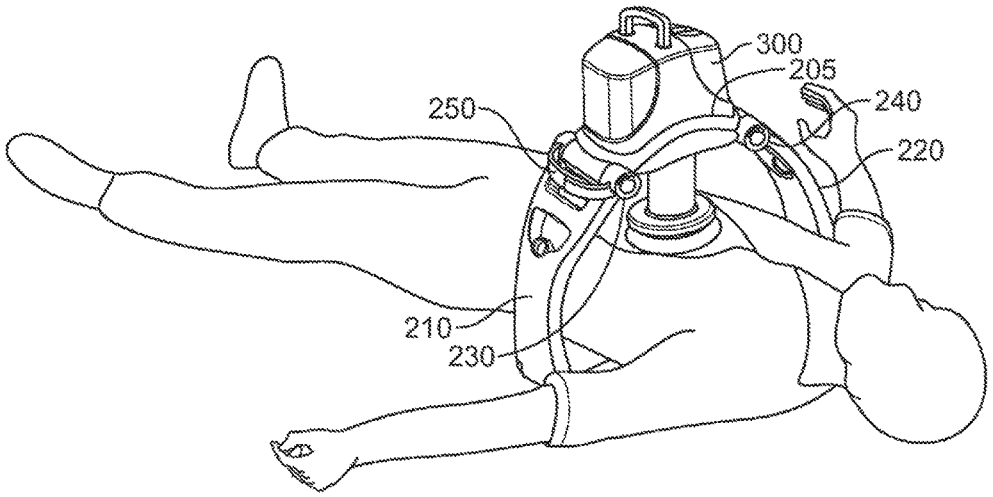
FIG. 9 shows an exemplifying situation of an embodiment of the invention in use.

FIG. 9 shows schematically a patient lying in the support structure 10 comprising a treatment unit 300 according to an embodiment of the invention. In the figure an arm fastening means 250 is also shown, which arm fastening means 250 is arranged for fixating the patient's arm or wrist when for example the patient is transported on a stretcher, whereby it is almost impossible for the patient to move in relation to the treatment unit 330. Thus it is possible to provide for example CPR with a negligible or reduced risk of providing treatment on a not desired body part. Further, when the patient's arms are secured by means of the arm fastening means 250, the patient can more easily be transported on e.g. a stretcher from a scene of an accident to an ambulance or from an ambulance to an emergency room at a hospital, since the arms will not be hanging loose from the stretcher. Furthermore, the patient can more easily be transported through doorways or small passages.

In an embodiment of the invention, the arm fastening means 250 is arranged at the front part 200 and more specifically an arm fastening means 250 is arranged at each leg 210, 220. In one embodiment of the invention, the arm fastening means 250 is arranged at the legs 210, 220 at a distance approximately corresponding to the length of a forearm from the second end 214, 224. Further, to enable quick and simple fastening and unfastening of the patient's arms, the arm fastening means 250 is configured as straps 250 manufactured of Velcro tape. But another suitable fastening means 250 can of course also be used.

Figure 8:
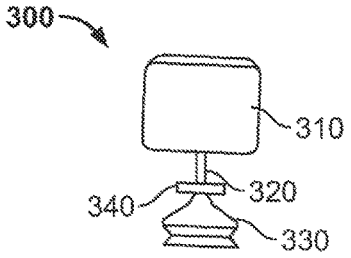
FIG. 8 shows schematically a treatment unit, which can be arranged at an embodiment of the support structure according to the invention.

In FIG. 8 an embodiment of a treatment unit 300 for compression and/or decompression is shown. The treatment unit or the compression/decompression unit 300 comprises a pneumatic unit 310 or another unit arranged to run and control the compression and/or decompression, an adjustable suspension unit or bellows unit 320 to which a compression and/or decompression pad 330 is attached. Further, the treatment unit 300 comprises a handle or a lever 340 by means of which the position of said pad 330 can be controlled, i.e. by means of which handle 340 the pad 330 can be moved towards or away from for example the chest of a patient. The suspension unit 320 is thus adjustably arranged to provide positioning of said pad 330. Further, the suspension unit 320 can comprise a sound absorbing material whereby the sound due to the compression and/or decompression is reduced.

The compression/decompression unit 300 is further arranged to provide a compression of the chest or sternum of the patient. In an embodiment of the invention, the treatment unit 300 is arranged to provide compression having a depth in the range of 20-90 millimeters, preferably in the range of 35-52 millimeters.

Furthermore, an embodiment of the invention comprises a compression pad 330 which is attachable to the chest, for example a compression pad 330 in the shape of a vacuum cup or a pad having an adhesive layer, the compression/decompression unit 300 can then also be arranged to provide decompression. That is the treatment unit 300 is able to expand the patient's chest to improve induced ventilation and blood circulation. In such an embodiment, the treatment unit 300 is configured to provide decompression having a height in the range of 0-50 millimeters, preferably in the range of 10-25 millimeters.

An embodiment of the treatment unit 300 is further arranged to provide compression and/or decompression having a frequency of approximately 100 compressions and/or decompressions per minute.

Due to the increased stability and the improved the fixation of the patient provided by the support structure 10 according to the invention, increased treatment accuracy is accomplished.

The compression force is in an embodiment of the invention in the range of 350-700 Newton, preferably approximately 500-600 Newton. The decompression force is in the range of 100-450 Newton depending on the kind of pad 330 used. That is, the need decompression force depends on for example if a vacuum cup or a pad having an adhesive layer is used but it also depends on the type of vacuum cup or adhesive layer. In an embodiment of the invention the decompression force is approximately 410 Newton but in another embodiment a decompression force in the range of 100-150 Newton is used.

The support structure 10 according to the invention is preferably manufactured of a lightweight material whereby a low weight of the support structure 10 is achieved. However, the material should be rigid enough to provide a support structure 10 that is durable, hard-wearing and stable. In some embodiments of the invention it is also desirable that the material of the support structure 10 is electrically insulating. To decrease the weight further, the support structure 10 can be provided with a selectable number of cavities or recesses.

In an embodiment of the support structure 10 according to the invention, the front part 200 are manufactured of a material comprising glass fiber and epoxy and has a core of porous PVC (polyvinyl chloride). The back plate 100 is in this embodiment manufactured of material comprising PUR (polyurethane) and has a core of porous PVC. In an embodiment of the invention comprising a treatment unit 300, the housing of the treatment unit is manufactured of PUR.

An embodiment of the support structure 10 comprising a compression and/or decompression unit 300 has a weight less than 6.5 kilogram. In an embodiment, the diametrical dimension in folded position is approximately 320×640×230 millimeters (width×height×depth) and in unfolded position approximately 500×538×228 millimeters (width×height×depth).

The present invention has been described by means of exemplifying embodiments. However, as understood by the person skilled in the art modifications can be made without departing from the scope of the present invention.

What is claimed is:

1. A support structure for cardiopulmonary resuscitation of a patient, comprising:

a curved back plate positionable posterior to a chest cavity of the patient, wherein a first side of the curved back plate comprises a shaft that is horizontally-disposed; and a front part positionable anterior to the chest cavity of the patient and structured to be attached to the curved back plate, the front part including:

a central part comprising an opening that is structured to receive a treatment unit, the treatment unit being configurable to run and control compression of the chest cavity of the patient, and two bowed, rigid legs, each of the two bowed, rigid legs extending from the central part and each including an end attachable to opposite portions of the curved back plate, the two bowed, rigid legs structured to maintain a fixed distance between the central part of the support structure and the curved back plate when the two bowed, rigid legs are attached to the curved back plate, wherein a first leg of the two bowed, rigid legs comprises a latch and a latch release that is offset from the latch along a length of the first leg, wherein the end of the first leg includes an opening configured to receive the shaft on the first side of the curved back plate, and wherein the latch is configured such that pressing the end of the first leg against the shaft causes the latch to at least partially surround the shaft on the first side of the curved back plate and removably secure the first leg to the shaft on the first side of the curved back plate.

2. The support structure of claim 1, wherein the latch release is configured to release the latch.

3. The support structure of claim 2, wherein the latch release is movable from a first position to a second position such that the latch is released and the first leg is releasable from the curved back plate.

4. The support structure of claim 1, wherein the front part is configured to pivot about the shaft on the curved back plate when the first leg is attached to the curved back plate and a second leg of the two bowed, rigid legs is not attached to the curved back plate.

5. A support structure for cardiopulmonary resuscitation of a patient, comprising:

a front part including:

a center portion comprising an opening that is structured to receive a treatment unit and is positionable over a chest of the patient, the treatment unit being configurable to run and control compression of the chest of the patient, and two bowed legs formed of a rigid material, the two bowed legs extending from the center portion and formed to extend around the patient; and a curved back plate positionable under the patient, a first side of the curved back plate comprising a shaft that is horizontally-disposed, wherein a first leg of the two bowed legs comprises a latch and a latch release that is offset from the latch along a length of the first leg, wherein an end of the first leg includes an opening configured to receive the shaft on the first side of the curved back plate, and wherein the latch is configured such that pressing the end of the first leg against the shaft causes the latch to at least partially surround the shaft on the first side of the curved back plate and removably secure the first leg to the shaft on the first side of the curved back plate.

6. The support structure of claim 5, wherein a second side of the curved back plate is structured to connect to a second leg of the two bowed legs.

7. The support structure of claim 5, wherein the latch release is configured to release the latch.

8. The support structure of claim 7, wherein the latch release is movable from a first position to a second position such that the latch is released and the first leg is releasable from the curved back plate.

9. A support structure for cardiopulmonary resuscitation of a patient having a cardiac arrest, comprising:

a curved back plate for positioning behind the patient's back posterior to the patient's heart, wherein a first side of the curved back plate comprises a shaft that is horizontally-disposed; and a front part for positioning around the patient's chest anterior to the patient's heart, the front part comprising a central part and two bowed, rigid legs, each respective one of the two bowed, rigid legs having an end that is removably attachable to different portions of the curved back plate, wherein:

the two bowed, rigid legs suspend the central part of the front part above the curved back plate when the front part is attached to the curved back plate, the central part comprises an opening that is adapted to receive a treatment unit, the treatment unit being configurable to run and control compression of the patient's chest when the front part is attached to the curved back plate, a first leg of the two bowed, rigid legs comprises a latch and a latch release that is offset from the latch along a length of the first leg, the end of the first leg includes an opening configured to receive the shaft on the first side of the curved back plate, and the latch is configured such that pressing the end of the first leg against the shaft causes the latch to at least partially surround the shaft on the first side of the curved back plate and removably secure the first leg to the shaft on the first side of the curved back plate.

10. The support structure of claim 9, wherein the treatment unit comprises an adjustable suspension unit to which a compression pad is attached, wherein the adjustable suspension unit is arranged to extend through the opening of the central part.

11. The support structure of claim 9:

wherein the latch release is configured to release the latch.

* * * * *